US008042352B2

(12) United States Patent
Deangelis

(10) Patent No.: US 8,042,352 B2
(45) Date of Patent: Oct. 25, 2011

(54) CONTROL METHOD AND DEVICE FOR AN AIR CONDITIONING ECONOMIZER SYSTEM

(75) Inventor: Darryl W. Deangelis, Longmeadow, MA (US)

(73) Assignee: BELIMO Holding AG, Hinwil (CH)

( * ) Notice: Subject to any disclaimer, the term of this patent is extended or adjusted under 35 U.S.C. 154(b) by 494 days.

(21) Appl. No.: 12/349,630

(22) Filed: Jan. 7, 2009

(65) Prior Publication Data

US 2010/0170272 A1 Jul. 8, 2010

(51) Int. Cl.
*F25D 23/12* (2006.01)
*F24F 7/00* (2006.01)
*G01M 1/38* (2006.01)

(52) U.S. Cl. ..... 62/260; 236/49.1; 700/275

(58) Field of Classification Search ..... 236/49.1; 62/157, 260; 700/275, 276, 278
See application file for complete search history.

(56) References Cited

U.S. PATENT DOCUMENTS 6,415,617 B1 * 7/2002 Seem ..... 62/186
2008/0179409 A1 * 7/2008 Seem ..... 236/49.3

* cited by examiner

*Primary Examiner* — Chen Wen Jiang
(74) *Attorney, Agent, or Firm* — Sughrue Mion, PLLC

(57) ABSTRACT

In an air conditioning economizer system outdoor air intake is reduced automatically by a control device based on a shut-off control setting for a measured outdoor air quality. A geographical location associated with the air conditioning economizer system is received (S2) in the control device. The control device defines automatically (S3) the shut-off control setting based on the geographical location. Thus, the air conditioning economizer system is adapted specifically for a geographic location and its climate zone, without the requirement for installing or operating personnel to determine a shut-off control setting for a specific climate zone and/or select a corresponding operating range.

17 Claims, 3 Drawing Sheets

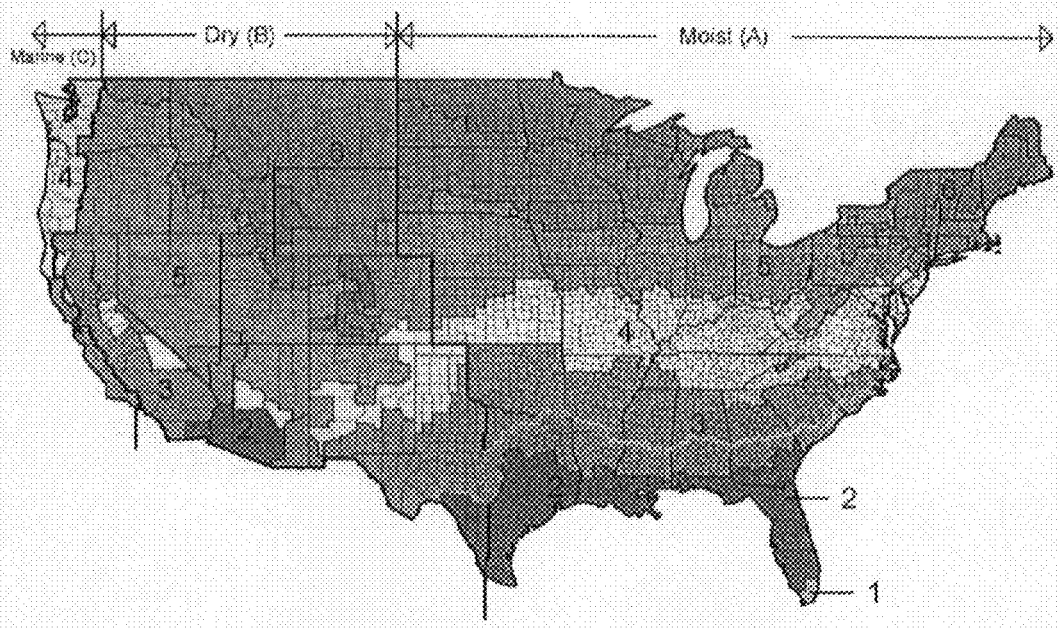

Fig. 1

| State County | Zone | State County | Zone | State County | Zone | State County | Zone |
|---|---|---|---|---|---|---|---|
| Alabama (AL) | | (Arkansas cont.) | | (Colorado cont.) | | Georgia (GA) | |
| Zone 3a Except | | Washington | 4A | Las Animas | 4B | Zone 3A Except | |
| Baldwin | 2A | California (CA) | | Otero | 4B | Appling | 2A |
| Mobile | 2A | Zone 3B Except | | Alamosa | 6B | Atkinson | 2A |
| Alaska (AK) | | Imperial | 2B | Archuleta | 6B | Bacon | 2A |
| Zone 7 Except | | Alameda | 3C | Chaffee | 6B | Baker | 2A |
| Bethel (CA) | 8 | Marin | 3C | Conejos | 6B | Berrien | 2A |
| Dillingham (CA) | 8 | Mendocino | 3C | Costilla | 6B | Brantley | 2A |
| Fairbanks North Star | 8 | Monterey | 3C | Custer | 6B | Brooks | 2A |
| Nome (CA) | 8 | Napa | 3C | Dolores | 6B | Bryan | 2A |

Fig. 2

CONTROL METHOD AND DEVICE FOR AN AIR CONDITIONING ECONOMIZER SYSTEM

FIELD OF THE INVENTION

The present invention relates to a control method and a control device for an air conditioning economizer system. Specifically, the present invention relates to a control method and a control device for reducing automatically in an air conditioning economizer system outdoor air intake based on a shut-off control setting for a measured outdoor air quality.

BACKGROUND OF THE INVENTION

In the building construction industry there exist many standards that are adopted into codes and by extension become local law. These codes govern mechanical and electrical systems, fire protection and life safety, structural, space, and envelop requirements, and energy conservation (Energy Code).

The Energy Code dictates requirements of a building envelop, Heating Ventilation and Air Conditioning (HVAC) systems, water heating, electrical power, and electrical lighting. Within this code are several references to the climate zone the building is being built in. Typically, the climate zones have been defined based on historical meteorological data collection of temperatures, humidity, snow fall, rain fall and other such weather occurrences. The Energy Code uses the climate zone to determine the materials and systems that are required to result in the best investment versus operating cost. Some building systems that are static such as the insulation and vapor barriers can be chosen and installed in the building to protect against extreme cold, heat, and humidity. Other systems such as air conditioning economizer systems are dynamic and have to be adjusted in the field rather than set in the factory in order to achieve the requirements of the Energy Code. The controls of these dynamic systems have to be parameterized such that they function to achieve highest operating energy efficiencies. If the controls are improperly set, they can reduce energy savings or in many cases increase energy use.

Within the Energy Code there are detailed requirements of the set points of operation of specific systems. In the case of air conditioning economizer systems, systems that use outdoor (outside) air to cool the building when conditions are suitable, the parameters of the control determine when air should be brought into a building and when it should not. For example, the specific climate zone setting as defined by the ASHRAE 90.1-2007 for the economizer system is shown in Table 1 below.

TABLE 1

| | | Required High Limit (Economizer Off When): | |
|---|---|---|---|
| Sensor Type | Climate Zones | Equation | Description |
| Fixed Dry Bulb | 1b, 2b, 3b, 3c, 4b, 4c, 5b, 5c, 6b, 7, 8 | $T_{OA} > 75°$ F. | Outdoor air temperature exceeds 75° F. |
| | 5a, 6a, 7a | $T_{OA} > 70°$ F. | Outdoor air temperature exceeds 70° F. |
| | All other zones | $T_{OA} > 65°$ F. | Outdoor air temperature exceeds 65° F. |
| Differential Dry Bulb | 1b, 2b, 3b, 3c, 4b, 4c, 5a, 5b, 5c, 6a, 6b, 7, 8 | $T_{OA} > T_{RA}$ | Outdoor air temperature exceeds return air temperature |
| Fixed Enthalpy | All | $h_{OA} > 28$ Btu/lb | Outdoor air enthalpy exceeds 28 Btu/lb of dry air[a)] |
| Electronic Enthalpy | All | $(T_{OA}, RH_{OA}) > A$ | Outdoor air temperature/RH exceeds the "A" set-point curve[b)] |
| Differential Enthalpy | All | $h_{OA} > h_{RA}$ | Outdoor air enthalpy exceeds return air enthalpy |
| Dew-point and dry-bulb temperatures | All | $DP_{OA} > 55°$ F. or $T_{OA} > 75°$ F. | Outdoor air dry bulb exceeds 75° F. or outside dew point exceeds 55° F.(65 gr/lb) |

[a)]At altitudes substantially different than sea level, the Fixed Enthalpy limit shall be set tothe enthalpy value at 75° F. and 50% relative humidity. As an example, at approximately 6000 ft elevation the fixed enthalpy limit is approximately 30.7 Btu/lb.
[b)]Setpoint "A" corresponds to a curve on the psychrometric chart that goes through a point at approximately 75° F. and 40% relative humidity and is nearly parallel to dry-bulb lines at low humidity levels and nearly parallel to enthalpy lines at high humidity levels.

To use Table 1, the installer has to know what sensor control type is being used in the system. This is listed in the 1$^{st}$ column. Listed in the 2$^{nd}$ column are the approved climate zones where these sensor control types can be used. The location of the climate zones are shown on a map, as illustrated in FIG. 1 for the USA, for example. The 3$^{rd}$ column indicates the allowed equations for the sensor types used. These equations set the high limit shut-off. This shut-off requires selection or parameterizing in the field.

The map in FIG. 1 (climate map and climate zones based in part on Köppen climate classification) shows not only the hot, moderate, and cold climate zones, but also indicates whether the zone is dry (B), moist (A), or very moist, i.e. marine (C). The setting of this system does not only determine when (seasonally) one should not bring hot air into a space to be cooled, but also when not to bring air that may be very moist. The moist air (humidity) will not only cause discomfort, but can result in conditions within the building that are suitable for mold growth, or provide other unhealthy air quality situations.

In a required climate zone setting according to the ASHRAE 90.1-2007 Energy Standard, all air economizers shall be capable of automatically reducing outdoor air intake to the design minimum outdoor air quantity when outdoor air intake will no longer reduce cooling energy usage. High-limit shut-off control settings shall be those listed in Table 1.

State of the art control devices require detailed review of the example table above by the installing or operating personnel to determine the correct set point, in order to meet the local law for the climate zone where the air conditioning economizer system is installed. Then the individual must select a corresponding operating range, e.g. through use of selector switch(es). If the individual does not have in his possession the tables and listing of climate zones, then the system can be incorrectly set up and result in energy waste and bad building conditions in moist climates. Multiple studies have proven this possibility to be true.

SUMMARY OF THE INVENTION

It is an object of this invention to provide a control method and a control device for reducing automatically in an air conditioning economizer system outdoor air intake based on a shut-off control setting (value) for a measured outdoor air quality, which control method and a control device do not have at least some of the disadvantages of the prior art. In particular, it is an object of the present invention to provide a control method and a control device for reducing automatically in an air conditioning economizer system outdoor air intake based on a shut-off control setting (value) for a measured outdoor air quality, which control method and control device do not require installing or operating personnel to determine a shut-off control setting (value) for a specific climate zone and/or select a corresponding operating range.

According to the present invention, these objects are achieved particularly through the features of the independent claims. In addition, further advantageous embodiments follow from the dependent claims and the description.

According to the present invention, the above-mentioned objects are particularly achieved in that a control device for reducing automatically in an air conditioning economizer system outdoor air intake, based on a shut-off control setting for a measured outdoor air quality, comprises a location determination module configured to determine a geographical location, and a configuration module configured to define automatically the shut-off control setting based on the geographical location. Specifically, the shut-off control setting is defined automatically based on the climate zone associated with the geographical location, Thus, the air conditioning economizer system is adapted specifically for a geographic location and its climate zone, without the requirement for installing or operating personnel to determine a shut-off control setting for a specific climate zone and/or select a corresponding operating range.

In an embodiment, the device further comprises a table for mapping geographical locations to shut-off control settings. Thus, for a given geographical location, the device determines the shut-off control directly from a table stored in the control device. In an alternative embodiment, the device includes a table for mapping geographical locations to climate zones, and the configuration module is configured to define the shut-off control setting based on the climate zone assigned to the geographical location. Thus, for a given geographical location, the device determines a climate zone from a climate zone table stored in the control device, and, subsequently, the device determines the shut-off control setting assigned to this climate zone.

In an embodiment, the location determination module includes a user interface for entering geographical location data defining the geographical location, and the geographical location data includes a postal code, an area code, a state and county name, and/or geographical coordinates. Thus, the device receives the geographical location data through a user interface. For example, the user interface includes a touch screen for displaying a geographical map and entering the geographical location data through touching a geographical location depicted on the geographical map.

In another embodiment, the location determination module includes a receiver for a satellite-based positioning system, e.g. a GPS receiver (Global Positioning System). Alternatively, the location determination module includes an interface for receiving geographical location data from an external receiver for a satellite-based positioning system. Thus, the geographical location is determined by way of an internal or external positioning receiver.

In yet a further embodiment, the configuration module is configured to define the shut-off control setting based on a sensor type which defines the type of sensor used for measuring the outdoor air quality. Thus, the device defines the shut-off control setting based on a sensor type configured for the control device.

In addition to the control device, the present invention also relates to a control method for reducing automatically in an air conditioning economizer system outdoor air intake based on a shut-off control setting for a measured outdoor air quality. The method comprises storing (at least temporarily) in a control device of the air conditioning economizer system a geographical location, and defining automatically in the control device the shut-off control setting based on the geographical location.

The present invention further relates to a control device for setting in an air conditioning economizer system a shut-off control value for limiting outdoor air intake based on a measured outdoor air quality, the device comprising a location determination module configured to receive geographical location data defining a geographical location, and a configuration module configured to define automatically the shut-off control value based on the geographical location data.

The present invention also relates to a control method for setting in an air conditioning economizer system a shut-off control value for limiting outdoor air intake based on a measured outdoor air quality. The method comprises receiving in a control device of the air conditioning economizer system geographical location data defining a geographical location, and defining automatically in the control device the shut-off control value based on the geographical location data.

BRIEF DESCRIPTION OF THE DRAWINGS

The present invention will be explained in more detail, by way of example, with reference to the drawings in which:

FIG. 1 shows an example of a map of climate zones relating to the United States of America.

FIG. 2 shows an example of a climate zone table with reference to the map of climate zones in the USA.

DETAILED DESCRIPTION OF THE PREFERRED EMBODIMENTS

Figure 3:
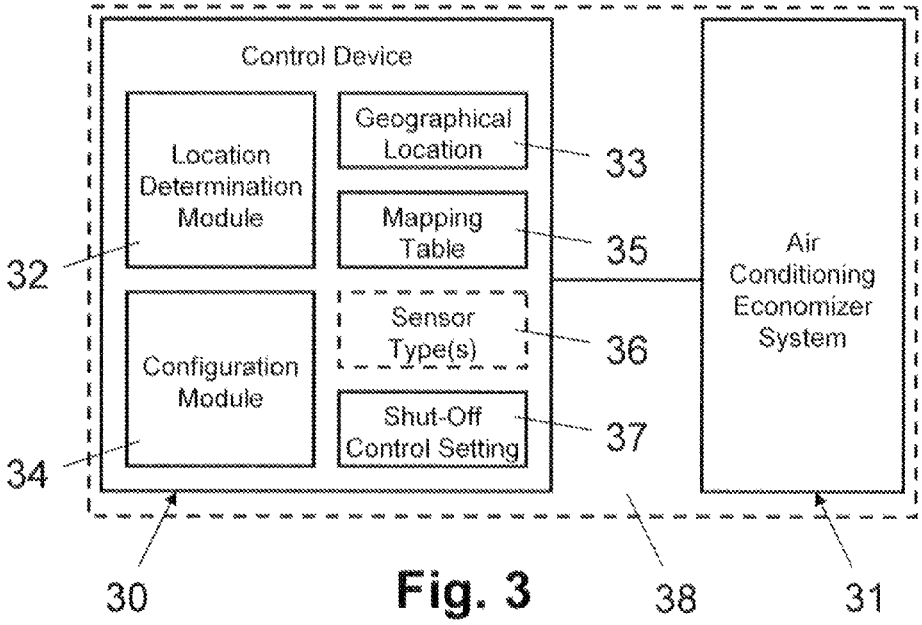
FIG. 3 shows a block diagram illustrating schematically an exemplary configuration of the control device for an air conditioning economizer system.

In FIG. 3, reference numeral 30 refers to a control device for an air conditioning economizer system 31. Depending on the embodiment, the control device 30 and the economizer system 31 are integrated in one common economizer housing 38, or the control device 30 is integrated in a separate controller housing connected through control wires to the economizer system 31.

The control device 30 is configured to reduce automatically in the economizer system 31 the outdoor air intake based on the value of a shut-off control setting for a measured outdoor air quality. For example, the air conditioning economizer system 31 includes sensors for measuring the temperature, humidity, dew point, and/or enthalpy of the outdoor air. In an embodiment, the economizer system 31 may also include sensors for measuring the air temperature and/or enthalpy of return air to the economizer system 31. One skilled in the art will understand that the air conditioning economizer system 31 may include other sensors and modules for determining various other types of air quality considered useful for controlling automatically based thereon the outdoor air intake in the economizer system 31.

As illustrated schematically in FIG. 3, in an embodiment, control device 30 includes a data store for storing the type of sensor(s) 36 used by the economizer system 31. For example, the type of sensor(s) 36 is stored in the control device 30 at manufacturing time (factory settings) or at installation time, e.g. entered manually or detected automatically from the economizer system 31 or the sensors.

In FIG. 3, reference numeral 32 refers to a location determination module for determining a geographical location. In various embodiments, the location determination module 32 includes preferably a user interface 50 for entering and receiving geographical location data defining the geographical location. Alternatively, the location determination module 32 includes a receiver for a satellite-based positioning system, or an interface for receiving geographical location data from an external receiver for a satellite-based positioning system. Preferably, the control device 1 includes a data store for storing the geographical location 33 or the geographical location data, respectively.

Figure 5:
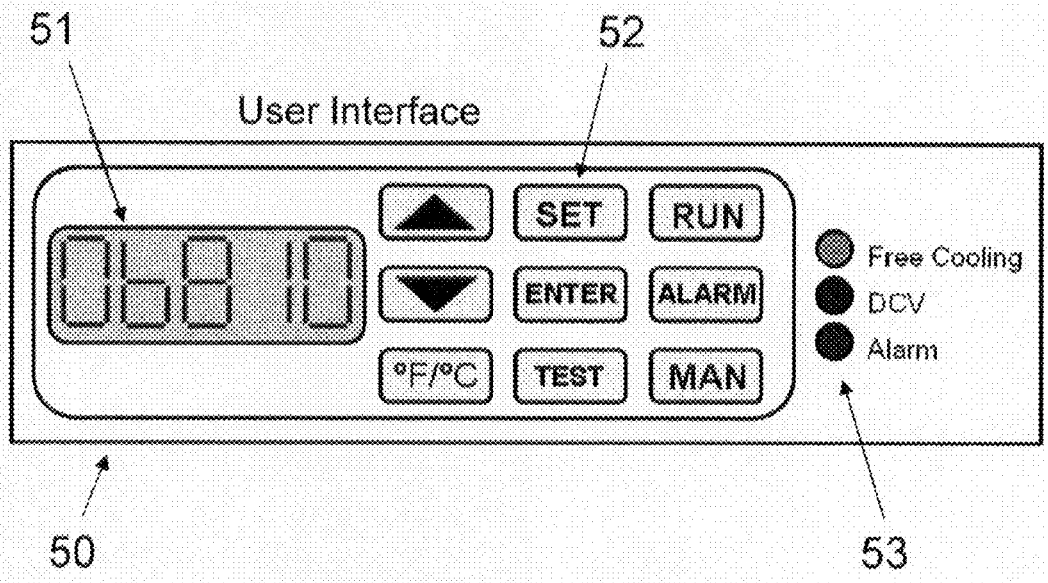
FIG. 5 shows a block diagram illustrating schematically an exemplary configuration of a user interface for the control device.

An example of a user interface 50 is illustrated in FIG. 5. The user interface 50 includes a display 51, e.g. an LED or LCD display, data entry elements 52, e.g. individual keys or a keypad or a sensitive touch screen, and optionally some status indicators, e.g. LED's, for indicating operational states of the economizer system 31. For example, the geographical location is defined by entering a postal code, e.g. a five digit ZIP code. Alternatively, the geographical location may be defined by entering coordinates or state and county names (and/or country, continent, etc.), for example. In another embodiment, the geographical location is defined using an interactive map, i.e. by selecting the geographical location, e.g. state, county, country, and/or continent, on a graphically displayed map, e.g. on a touch screen.

In the embodiments for determining automatically the geographical location by way of a receiver for a satellite-based positioning system, e.g. a GPS receiver, the geographical location data, i.e. the geographical coordinates, are determined automatically by a respective receiver included in the control device 30 or via a receiver interface for connecting an external receiver to the control device 30. For example, the receiver interface includes a receptacle for connecting an external receiver via a wire connector. One skilled in the art will understand, that alternatively an external receiver can be connected to the control device 30 via a wireless interface, e.g. through Bluetooth.

The user interface 50 or the receiver, respectively, is controlled by a (micro-)processor of the control device 30. The (micro-)processor is configured to receive and store the geographical location 33 or the geographical location data, respectively.

In FIG. 3, reference numeral 34 refers to a configuration module for determining automatically the shut-off control setting (i.e. shut-off control value) based on the geographical location 33. As will be explained later in more detail with reference to FIGS. 4 and 6, the configuration module 34 determines the shut-off control setting based on a mapping table 35 stored in the control device 30. The control device 30 includes a data store for storing the shut-off control setting 37. Preferably, the configuration module 34 is implemented as a programmed software module, comprising computer program code for controlling the (micro-)processor of the control device 30. One skilled in the art will understand, however, that, in alternative embodiments, the configuration module 34 can be implemented fully or partly be means of hardware elements.

Figure 4:
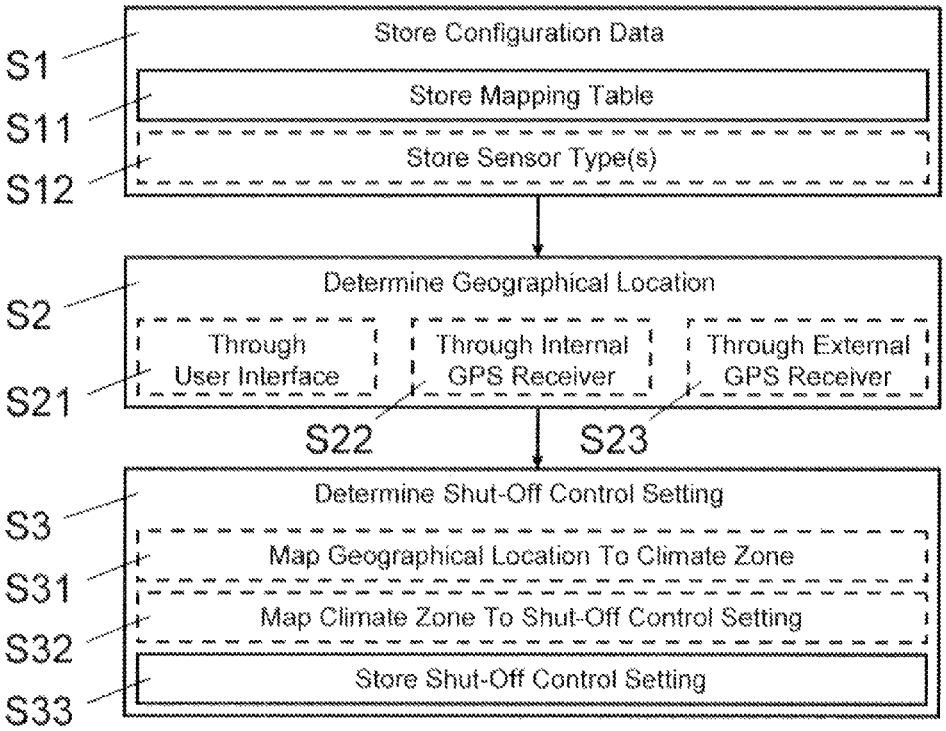
FIG. 4 shows a flow diagram illustrating an exemplary sequence of steps for setting the shut-off control setting of an air conditioning economizer system.
Figure 6:
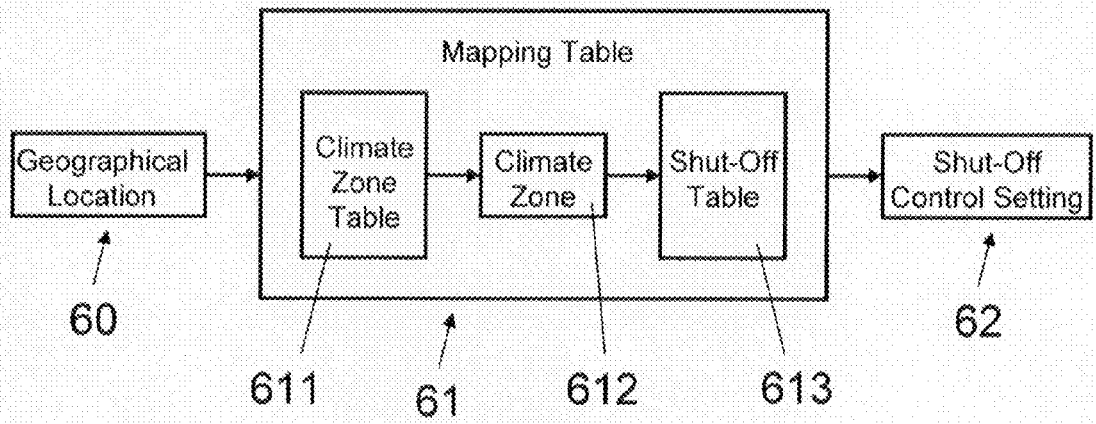
FIG. 6 shows a block diagram illustrating schematically the mapping of a geographical location to a shut-off control setting.

In the following paragraphs, described with reference to FIGS. 4 and 6 are possible sequences of steps for defining automatically for the economizer system 31 the shut-off control setting (i.e. shut-off control value) used as a criteria for reducing or limiting in the economizer system outdoor air intake depending on a measured outdoor air quality.

In preparatory step S1, the control device 30 is provided with configuration data, for example, configuration data for interoperating with a specific type of economizer system 31 and/or sensor type(s).

In preparatory step S11, the mapping table 35 is stored in control device 30. As is illustrated in FIG. 6, the mapping table 61 is set up to map a given geographical location 60 to an associated shut-off control setting 62 (i.e. shut-off control value). Thus, the mapping table 61 includes geographical locations 60 assigned in each case to a shut-off control setting 62. Preferably, the mapping table 35 is set up for the specific type of sensor(s) used by the economizer system 31, thus there is no need to store the type of sensor(s) 36) in the control device 30. Alternatively, the mapping table 35 includes shut-off control settings for different types of sensor(s) 36, which are selected based on the type of sensor(s) 36 stored in the control device 30.

As indicated schematically in FIG. 6, in an embodiment, the mapping table 61 includes mapping sub-tables: a climate zone table 611 for mapping a given geographical location 60 to an associated climate zone 612, and a shut-off table 613 for mapping a determined climate zone 612 to an associated shut-off control setting 62. Thus, the climate zone table 611 includes geographical locations 60 assigned in each case to a climate zone 612; and the shut-off table 613 includes climate zones 612 assigned in each case to a shut-off control setting 62. One skilled in the art will understand, that the mapping (sub-)tables can be implemented as stored data tables or as programmed mapping functions.

As illustrated in FIG. 1 for the example of the United States, climate zones are regional and divided in areas with geographical boarders. FIG. 2 shows a partial table listing the climate zones in alphabetical order by state and county, for the example of the United States.

In optional preparatory step S12, the type of sensor(s) 36) used by the economizer system 31 is stored in the control device 30.

In step S2, determined and (at least temporarily) stored by the location determination module 31 is the geographical location where the economizer system 31 is installed and operated. Depending on the embodiment, in step S21, the geographical location data is entered manually through the user interface 50 or determined automatically in steps S22 or S23, respectively. Manual entry of the geographical location data is possible before the economizer system 31 is actually positioned and installed at its destined location. If applicable, in step S22, the receiver of the location determination module 31 is activated and determines and stores the coordinates of the current location of the economizer system 31. Alternatively, if applicable, in step S23, an external receiver is connected to the control device 30 through the receiver interface of the location determination module 31, and the coordinates of the current location of the economizer system 31 are received by the location determination module 31.

In step S3, the shut-off control setting (i.e. shut-off control value) is determined from the geographical location 33 determined and stored in step S2. The shut-off control setting is determined by the configuration module 34 using the mapping table 35, 61.

In an embodiment, the shut-off control setting is determined in a two-step approach using the mapping sub-tables. Thus, if applicable, in step S31, the configuration module 34 determines the climate zone 612 associated with the geographical location 33 from the climate zone table 611. Subsequently, if applicable, in step S32, the configuration module 34 determines the shut-off control setting 62 associated with the climate zone 612 from the shut-off table 613.

In step S33, the shut-off control setting 62 is stored in the control device 30 as the operative shut-off control setting 37 (i.e. shut-off control value) for the economizer system 31.

It should be noted that, in the description, the computer program code has been associated with specific functional modules and the sequence of the steps has been presented in a specific order, one skilled in the art will understand, however, that the computer program code may be structured differently and that the order of at least some of the steps could be altered, without deviating from the scope of the invention.

The invention claimed is:

1. A control device for reducing automatically in an air conditioning economizer system outdoor air intake based on a shut-off control setting for a measured outdoor air quality, wherein the device comprises:

a location determination module configured to determine a geographical location; and a configuration module configured to define automatically the shut-off control setting based on the geographical location.

2. The device of claim 1, further comprising a table for mapping geographical locations to shut-off control settings.

3. The device of claim 1, wherein the device further comprises a table for mapping geographical locations to climate zones; and the configuration module is configured to define the shut-off control setting based on the climate zone assigned to the geographical location.

4. The device of claim 1, wherein the location determination module includes a user interface for entering geographical location data defining the geographical location; and the geographical location data includes at least one of a postal code, an area code, state and county names, and geographical coordinates.

5. The device of claim 4, wherein the user interface includes a touch screen for displaying a geographical map and entering the geographical location data through touching a geographical location depicted on the geographical map.

6. The device of claim 1, wherein the location determination module includes a receiver for a satellite-based positioning system.

7. The device of claim 1, wherein the location determination module includes an interface for receiving geographical location data from an external receiver for a satellite-based positioning system.

8. The device of claim 1, wherein the configuration module is configured to define the shut-off control setting based on a sensor type which defines the type of sensor used for measuring the outdoor air quality.

9. A control method for reducing automatically in an air conditioning economizer system outdoor air intake based on a shut-off control setting for a measured outdoor air quality, wherein the method comprises:

storing in a control device of the air conditioning economizer system a geographical location; and defining automatically in the control device the shut-off control setting based on the geographical location.

10. The method of claim 9, wherein the shut-off control setting is determined from a table which is stored in the control device and maps geographical locations to shut-off control settings.

11. The method of claim 9, wherein defining the shut-off control setting includes determining, from a climate zone table stored in the control device, a climate zone assigned to the geographical location, and defining the shut-off control setting based on the climate zone assigned to the geographical location.

12. The method of claim 9, wherein geographical location data defining the geographical location is received through a user interface, the geographical location data including at least one of a postal code, an area code, state and county names, and geographical coordinates.

13. The method of claim 9, wherein the geographical location is determined by way of a receiver for a satellite-based positioning system.

14. The method of claim 9, wherein the shut-off control setting is defined based on a sensor type used for measuring the outdoor air quality.

15. A computer program product including a computer readable medium comprising computer program code means for controlling one or more processors of a control device for an air conditioning economizer system such that the control device performs the steps of storing in the control device a geographical location; and defining automatically in the control device, based on the geographical location, a shut-off control setting associated with a measured outdoor air quality for reducing automatically in the air conditioning economizer system outdoor air intake based on the shut-off control setting.

16. A control device for setting in an air conditioning economizer system a shut-off control value for limiting outdoor air intake based on a measured outdoor air quality, wherein the device comprises:

a location determination module configured to receive geographical location data defining a geographical location; and a configuration module configured to define automatically the shut-off control value based on the geographical location data.

17. A control method for setting in an air conditioning economizer system a shut-off control value for limiting outdoor air intake based on a measured outdoor air quality, wherein the method comprises:

receiving in a control device of the air conditioning economizer system geographical location data defining a geographical location; and defining automatically in the control device the shut-off control value based on the geographical location data.

* * * * *